US006555515B1

(12) United States Patent
Hees et al.

(10) Patent No.: US 6,555,515 B1
(45) **Date of Patent: *Apr. 29, 2003**

(54) FORMULATIONS FOR CLEANING HARD SURFACES BASED ON AT LEAST PARTLY BRANCHED-CHAIN ALKYL OLIGOGLUCOSIDES

(75) Inventors: Udo Hees, Duisburg (DE); Eva Kiewert, Duesseldorf (DE); Rainer Eskuchen, Langenfeld (DE)

(73) Assignee: Henkel Kommanitgesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/761,467

(22) Filed: Dec. 6, 1996

Related U.S. Application Data

(60) Provisional application No. 60/012,827, filed on Mar. 5, 1996.

(30) Foreign Application Priority Data

Dec. 6, 1995 (DE) ..... 195 45 486

(51) Int. Cl.[7] ..... C11D 1/66
(52) U.S. Cl. ..... 510/470; 510/470; 510/535
(58) Field of Search ..... 510/470, 535; 252/FOR 239, FOR 240

(56) References Cited

U.S. PATENT DOCUMENTS

| | | | | | |
|---|---|---|---|---|---|
| 3,839,318 | A | * | 10/1974 | Mansfield | 536/18.6 |
| 4,606,850 | A | | 8/1986 | Malik | 252/528 |
| H171 | H | * | 12/1986 | McDaniel et al. | 510/535 |
| 4,732,696 | A | * | 3/1988 | Urfer | 252/174.17 |
| 4,732,704 | A | | 3/1988 | Biermann et al. | 252/548 |
| 5,138,046 | A | * | 8/1992 | Wuest et al. | 536/18.6 |
| 5,374,716 | A | | 12/1994 | Biermann et al. | 536/186.6 |
| 5,554,742 | A | * | 9/1996 | Wolf et al. | 536/18.6 |
| 5,576,425 | A | * | 11/1996 | Hill et al. | 536/18.6 |
| 5,585,472 | A | * | 12/1996 | Wolf et al. | 536/18.6 |
| 5,599,476 | A | * | 2/1997 | Behler et al. | 510/135 |
| 5,644,041 | A | * | 7/1997 | Johansson | 536/4.1 |

FOREIGN PATENT DOCUMENTS

| | | | |
|---|---|---|---|
| EP | 210 270 | | 2/1987 |
| EP | 214 285 | | 3/1987 |
| EP | 216 301 | | 4/1987 |
| EP | 282 863 | | 9/1988 |
| EP | 301 298 | | 2/1989 |
| EP | 199 765 | | 5/1990 |
| EP | 388 810 | | 9/1990 |
| EP | 510 870 | | 10/1992 |
| EP | 572 776 | | 12/1993 |
| WO | WO 86/05199 | | 9/1986 |
| WO | WO 86/05509 | | 9/1986 |
| WO | WO 90/03977 | | 4/1990 |
| WO | WO 92/03582 | | 3/1992 |
| WO | 94/21769 | * | 9/1994 |

OTHER PUBLICATIONS

Derwent Abstract accession No. 92–197678/199224, for RD 337088, published May 10, 1992.*

J. Falbe, "Surfactants in Consumer Products", Springer Verlag, Berlin, 1987, pp. 54–124.

J. Falbe, "Katalysatoren, Tenside und Mineralöladditive", Thieme Verlag, Stuttgart, 1978, pp. 123–217.

Seifen–Öle–Fette–Wachse, 112, 1986, p. 371.

* cited by examiner

*Primary Examiner*—Cynthia H. Kelly
*Assistant Examiner*—Dawn L. Garrett
(74) *Attorney, Agent, or Firm*—Stephen D. Harper; Glenn E. J. Murphy

(57) ABSTRACT

The invention relates to new formulations for cleaning hard surfaces containing—based on the formulation—1 to 50% by weight of alkyl oligoglucosides corresponding to formula (I):

$$R^1O—[G]_p \qquad (I)$$

in which $R^1$ is an at least partly branched alkyl radical containing 9 to 11 carbon atoms, G is a glucose unit and p is a number of 1.4 to 2.0. The products are distinguished by an improved cleaning performance in relation to formulations based on linear alkyl oligoglucosides.

4 Claims, No Drawings

FORMULATIONS FOR CLEANING HARD SURFACES BASED ON AT LEAST PARTLY BRANCHED-CHAIN ALKYL OLIGOGLUCOSIDES

BENEFIT OF EARLIER FILING DATE UNDER 37 CFR 1.78(a) (4)

This application claims the benefit of earlier filed and copending provisional application Ser. No. 60/012,827, filed on Mar. 5, 1996, the entire contents of which are incorporated herein by reference.

BACKGROUND OF THE INVENTION

1. Field of the Invention

This invention relates to formulations containing selected alkyl and/or alkenyl oligoglycosides for cleaning hard surfaces.

2. Description of the Related Art

Cleaning formulations containing alkyl oligoglucosides are already known from a number of prior art publications, cf. European patent applications EP-A 0 199 765, EP-A 0 210 270, EP-A 0 214 285, EP-A 216 301, EP-A 0 282 863 (Henkel), EP-A 0 572 776 (Hüls), EP-A 0 388 810, EP-A 0 510 870 (Kao) and International patent application WO 92/03582 (R&C). However, these publications only disclose the use of linear alkyl oligoglucosides with an average degree of polymerization of 1.3 to 1.4.

However, it has been found in the past that corresponding formulations are not always satisfactory in regard to their performance properties. Thus, glucoside-containing cleaning formulations show inadequacies in their cleaning effect against obstinate soils. They are occasionally difficult to thicken, i.e. problems are involved in adjusting the viscosity of the products to a value which is low enough to facilitate easy dispensing, but high enough to ensure that the product does not flow too quickly off vertical surfaces. Finally, foaming power, for example in the case of carpet shampoos and oven cleaners, is not always satisfactory. Accordingly, the problem addressed by the present invention was to remedy these deficiencies.

Description of the Invention

The present invention relates to formulations for cleaning hard surfaces which contain—based on the formulation—from 1 to 50, preferably from 1.5 to 15 and more preferably from 2 to 8% by weight of alkyl oligoglucosides corresponding to formula (I):

$$R^1O—[G]_p \quad (I)$$

in which $R^1$ is an at least partly branched alkyl radical containing 9 to 11 carbon atoms, G is a glucose unit and p is a number of 1.4 to 2.0 and preferably a number of 1.5 to 1.7.

It has surprisingly been found that alkyl oligoglucosides based on short-chain oxoalcohols show better cleaning power than glucosides based on linear fatty alcohols of comparable chain length and DP within a selected degree of polymerization (DP) range. The products may readily be adjusted to an in-use viscosity and provides an adequate amount of stable foam, even in the presence of strong alkalis.

Alkyl Oligoglucosides

Alkyl oligoglucosides are known nonionic surfactants which may be obtained by the relevant methods of preparative organic chemistry. EP-A1-0 301 298 and WO 90/03977 are cited as representative of the extensive literature available on the subject. The index p in general formula (I) indicates the degree of oligomerization (DP degree), i.e. the distribution of mono- and oligoglycosides. Whereas p in a given compound must always be an integer, the value p for a certain alkyl oligoglycoside is an analytically determined calculated quantity which is mostly a broken number. The alkyl radical $R^1$ may be derived from primary alcohols containing 9 to 11 carbon atoms. Preferred starting materials are oxoalcohols with a corresponding chain length which may contain 5 to 25 mole-% of branched species from their production. The preferred starting material for the production of the alkyl oligoglucosides is an oxoalcohol marketed by Shell under the name of DOBANOL® 91.

Surfactants

In addition to the glycosides, the formulations according to the invention may contain other anionic, nonionic, cationic and/or amphoteric and/or zwitterionic surfactants.

Typical examples of anionic surfactants are alkylbenzenesulfonates, alkanesulfonates, olefin sulfonates, alkylether sulfonates, glycerol ether sulfonates, α-methyl ester sulfonates, sulfofatty acids, alkylsulfates, fatty alcohol ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, acyl lactylates, acyl tartrates, acyl glutamates, acyl aspartates, alkyl oligoglucoside sulfates, protein fatty acid condensates (particularly wheat-based vegetable products) and alkyl (ether) phosphates. If the anionic surfactants contain polyglycol ether chains, they may have a conventional homolog distribution although they preferably have a narrow-range homolog distribution.

Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers and mixed formals, fatty acid N-alkyl glucamides, protein hydrolyzates (particularly wheat-based vegetable products), polyol fatty acid esters, sugar esters, sorbitan esters, polysorbates and amine oxides. If the nonionic surfactants contain polyglycol ether chains, they may have a conventional homolog distribution, although they preferably have a narrow-range homolog distribution.

Typical examples of cationia surfactants are quaternary ammonium compounds and esterquats, more particularly quaternized fatty acid trialkanolamine ester salts. Typical examples of amphoteric or zvitterionic surfactants are alkylbetaines, alkylamidobetaines, aminopropionates, aminoglycinates, imidazolinium betaines and sulfobetaines.

The surfactants mentioned are all known compounds. Information on their structure and production can be found in relevant synoptic works, cf. for example J. Falbe (ed.), "Surfactants in Consumer Products", springer Verlag, Berlin, 1987, pages 54 to 124 or J. Falbe (ed.), "Katalysatoren, Tenside und Mineralöladditive (Catalysts, Surfactants and Mineral Oil Additives)", Thieme Verlag, Stuttgart, 1978, pages 123–217. The percentage content of the other surfactants in the formulations according to the invention may be from 1 to 50% by weight and is preferably from 2 to 25% by weight.

Other Auxiliaries and Additives

The formulations according to the invention may contain other typical auxiliaries and additives such as, for example, liquid builders and sequestering agents such as, for example, citric acid, gluconic acid and alkali metal salts thereof, EDTA and/or NTA, solubilizers such as, for example, butyl glucoside, toluene, xylene and/or cumene sulfonate, lower aliphatic alcohols such as, for example, ethanol, isopropyl alcohol and/or propylene glycol, fatty acids containing 8 to 22 carbon atoms such as, for example, coconut oil or palm kernel oil fatty acid, dicarboxylic acids such as, for example, succinic acid, glutaric acid and/or adipic acid, abrasives such as, for example, silica flour, layer silicates, thickeners, polymers such as, for example, polyethylene glycols having molecular weights in the range from 100,000 to 1,000,000 dalton, alkali bases such as, for example, sodium hydroxide, potassium hydroxide, ammonia solution or triethanolamine for adjusting a basic pH value and perfumes and dyes. The auxiliaries and additives may make up from 1 to 50% by weight and preferably from 2 to 25% by weight of the formulations.

Commercial Applications

The formulations according to the invention show advantageous foaming and cleaning power. They have an adequate, but not excessively high viscosity, so that they are easy to dispense and flow without difficulty on the surfaces to be cleaned. Typical examples of formulations which fulfil this purpose are multipurpose cleaners, sanitary cleaners, window cleaners, scouring preparations, floor cleaners, carpet shampoos and oven cleaners. The non-aqueous component (corresponding to the active substance content) of the formulations is normally from 5 to 75% by weight. For dilute applications, the active substance content is in the range from 5 to 35 and preferably 7 to 25% by weight and, for concentrates, in the range from 35 to 75 and preferably 50 to 60% by weight.

EXAMPLES

I. Cleaning Performance

Cleaning performance was tested against an artificially soiled plastic surface by the method described in Seifen-Öle-Fette-Wachse, 112, 371 (1986). The test solutions (pH= 9.4) had the following composition (water to 100% by weight):

| | |
|---|---|
| Alkyl oligoglucoside | 7.0% by weight |
| $C_{10/14}$ fatty alcohol · 8.5 EO | 2.0% by weight |
| $C_{12/14}$ fatty alcohol · 2 EO sulfate sodium salt | 2.0% by weight |
| $C_{12/18}$ cocofatty acid | 0.4% by weight |
| Sodium gluconate | 1.0% by weight |

A mixture of soot, machine oil, grease and low-boiling hydrocarbons was used as the soil for dilute application of the cleaning formulation. The 26×28 cm test surface was uniformly coated with 2 g of the artificial soil using a surface coater. A plastic sponge was then soaked with 10 ml of the test solution and moved mechanically over the test surface which had also been coated with 10 ml of the test solution. After 10 wiping movements, the cleaned test surface was held under running water and the loose soil was removed. The cleaning effect, i.e. the whiteness of the plastic surface thus cleaned, was photometrically determined against a standard (corresponding to 100% reflectance). The results are set out in Table 1. Table 2 contains a number of Formulation Examples.

TABLE 1

Cleaning performance

| | Alkyl Oligoglucoside | | Cleaning Power |
|---|---|---|---|
| Example | Chain Length | DP | % Reflectance |
| 1 | 9/10 | 1.43 | 58 |
| 2 | 9/10 | 1.52 | 61 |
| 3 | 9/10 | 1.60 | 66 |
| C1 | 8/10 | 1.38 | 48 |
| C2 | 8/10 | 1.59 | 47 |
| C3 | 8 | 1.60 | 51 |
| C4 | 9/10 | 1.32 | 49 |

TABLE 2

II. Formulation Examples
Formulations for cleaning hard surfaces

| Formulation | Components | Content % by weight |
|---|---|---|
| Concentrated multipurpose cleaner | $C_{9/11}$ Alkyl polyglucoside (DP = 1.55) | 45.0 |
| | Lauric acid methyl ester · 13 EO | 20.0 |
| | Palm kernel oil fatty acid | 5.0 |
| | Citric acid | 1.0 |
| | Cumene sulfonate | 10.0 |
| | Potassium hydroxide (50% by weight) | 0.5 |
| Multipurpose spray cleaner | $C_{9/11}$ Alkyl polyglucoside (DP = 1.50) | 2.0 |
| | Butyl glucoside | 0.5 |
| | Octanol · 10 EO | 1.5 |
| | Palm kernel oil fatty acid | 1.0 |
| | Glutaric/adipic acid mixture (1:1) | 2.0 |
| | Polyethylene oxide (MW 600,000) | 0.05 |
| | Butyl glycol | 2.0 |
| | Sodium hydroxide (50% by weight) | 0.2 |
| Multipurpose spray cleaner | $C_{9/11}$ Alkyl polyglucoside (DP = 1.60) | 0.2 |
| | Lauric acid methyl ester · 17 EO | 0.05 |
| | Coconut oil fatty acid | 0.001 |
| | Ethanol | 7.0 |
| | Ammonia solution (50% by weight) | 0.1 |

TABLE 2-continued

II. Formulation Examples
Formulations for cleaning hard surfaces

| Formulation | Components | Content % by weight |
|---|---|---|
| Multipurpose cleaner | $C_{9/11}$ Alkyl polyglucoside (DP = 1.61) | 12.0 |
| | $C_{9/11}$ Oxoalcohol · 8 EO | 8.0 |
| | Lauryl sulfate sodium salt | 2.0 |
| | Ethanol | 5.0 |
| | Sodium hydroxide (50% by weight) | 0.2 |
| Multipurpose cleaner | $C_{9/11}$ Alkyl polyglucoside (DP = 1.55) | 10.0 |
| | Lauric acid methyl ester · 18 EO | 8.0 |
| | Secondary octadecane sulfonate sodium salt | 2.0 |
| | Cumene sulfonate | 3.0 |
| | Coconut oil fatty acid | 1.5 |
| | Ethanol | 5.0 |
| | Sodium hydroxide (50% by weight) | 0.2 |
| Multipurpose cleaner | $C_{9/11}$ Alkyl polyglucoside (DP = 1.55) | 10.0 |
| | Lauric acid methyl ester · 17 EO | 8.0 |
| | Secondary octadecane sulfonate sodium salt | 2.0 |
| | Coconut oil fatty acid | 1.5 |
| | Ethanol | 5.0 |
| | Sodium hydroxide (50% by weight) | 0.2 |
| Multipurpose cleaner | $C_{9/11}$ Alkyl polyglucoside (DP = 1.50) | 12.0 |
| | Lauric acid methyl ester · 11 EO | 8.0 |
| | Cocofatty alcohol · 2 EO sulfate sodium salt | 2.0 |
| | Ethanol | 5.0 |
| | Potassium hydroxide | 0.2 |
| Multipurpose cleaner | $C_{9/11}$ Alkyl polyglucoside (DP = 1.53) | 12.0 |
| | Octanol · 4 EO | 8.0 |
| | Cocofatty alcohol · 2 EO sulfate sodium salt | 2.0 |
| | Ethanol | 5.0 |
| | Sodium hydroxide (50% by weight) | 0.2 |
| Scouring preparation | $C_{9/11}$ Alkyl polyglucoside (DP = 1.53) | 1.5 |
| | 2-Butene dilauryl ester sulfonate sodium salt | 1.5 |
| | Thickener (ACRYSOL ® ICS-1) | 1.0 |
| | Silica flour | 50.0 |
| | Triethanolamine | 0.5 |
| Window cleaner | $C_{9/11}$ Alkyl polyglucoside (DP = 1.52) | 1.0 |
| | $C_{8/10}$ Fatty alcohol · 6 EO | 1.0 |
| | Ethanol | 8.0 |
| | Butyl glycol | 2.0 |
| Carpet shampoo | $C_{9/11}$ Alkyl polyglucoside (DP = 1.50) | 26.0 |
| | Sodium gluconate | 3.0 |
| Floor cleaner | $C_{9/11}$ Alkyl polyglucoside (DP = 1.55) | 14.0 |
| | SYNTRAN ® (Kahl) | 18.0 |
| | SEQUION ® 40 Na 32 (Polygon) | 1.2 |
| | Ammonia solution (50% by weight) | 0.2 |
| Floor cleaner | $C_{9/11}$ Alkyl polyglucoside (DP = 1.55) | 5.0 |
| | Decanol · 10 EO | 4.0 |
| | Spezialwachs 2826 (Kahl) | 7.0 |
| | SEQUION ® 40 Na 32 (Polygon) | 0.5 |
| | Potassium hydroxide (50% by weight) | 0.5 |
| Oven cleaner | $C_{9/11}$ Alkyl polyglucoside (DP = 1.60) | 4.0 |
| | Alkylbenzenesulfonate sodium salt | 6.0 |
| | Potassium hydroxide | 4.0 |
| | Propylene glycol | 10.0 |
| | Laponite (layer silicate) | 1.0 |
| Oven cleaner | $C_{9/11}$ Alkyl polyglucoside (DP = 1.62) | 4.0 |
| | Cocofatty alcohol · 1 PO · 4 EO | 2.0 |
| | Citric acid | 6.0 |
| | Perfume | 1.0 |
| | Ammonia solution (50% by weight) | 0.2 |

What is claimed is:

1. In a hard surface cleaning composition which comprises one or more anionic, nonionic, amphoteric or zwitterionic surfactants or combination thereof the improvement comprising from about 1 to about 50% by weight of alkyl oligoglucosides corresponding to formula (I):

$$R^1O—[G]_p \quad (I)$$

wherein $R^1$ is an at least partly branched alkyl radical having from about 9 to about 11 carbon atoms, G is a glucose unit and p is a number from 1.4 to 2.0, and wherein the alkyl oligoglucosides are derived from $C_{9-11}$ oxoalcohols obtained from terminal linear olefins.

2. The composition of claim 1 wherein said composition is comprised of from about 5 to about 75% by weight of active substance.

3. A method of increasing the viscosity and foam of a hard surface cleaning composition which is comprised of one or more anionic, nonionic, amphoteric or zwitterionic surfactants or combination thereof which method is comprised of adding to said cleaning composition from about 1 to about 50% by weight of alkyl oligoglucosides corresponding to formula (I):

$$R^1O—[G]_p \quad (I)$$

wherein $R^1$ is an at least partly branched alkyl radical having from about 9 to about 11 carbon atoms, G is a glucose unit and p is a number from 1.4 to 2.0, and wherein the alkyl oligoglucosides are derived from $C_{9-11}$ oxoalcohols obtained from terminal linear olefins.

4. The method of claim 3 wherein said composition is comprised of from about 5 to about 75% by weight of active substance.

* * * * *